US006330774B1

(12) United States Patent
Weinstein

(10) Patent No.: US 6,330,774 B1
(45) Date of Patent: Dec. 18, 2001

(54) PREFABRICATED TILED PANEL SYSTEM

(76) Inventor: Albert I Weinstein, 28710 Alford Dr., Rancho Palos Verdes, CA (US) 90275

( * ) Notice: Subject to any disclaimer, the term of this patent is extended or adjusted under 35 U.S.C. 154(b) by 0 days.

(21) Appl. No.: 09/624,833

(22) Filed: Jul. 25, 2000

Related U.S. Application Data

(63) Continuation-in-part of application No. 09/334,899, filed on Jun. 17, 1999, now Pat. No. 6,128,793.

(51) Int. Cl.[7] ..... B44F 7/00
(52) U.S. Cl. ..... 52/314; 52/389; 52/391
(58) Field of Search ..... 52/314, 389, 391

(56) References Cited

U.S. PATENT DOCUMENTS

| | | | | |
|---|---|---|---|---|
| 1,827,053 | | 10/1931 | Veneman . | |
| 1,926,257 | * | 9/1933 | Bawtwnheimer | 52/314 |
| 2,592,244 | * | 4/1952 | Chamberlain | 52/314 |
| 3,350,827 | * | 11/1967 | Sugar | 52/314 X |
| 4,771,488 | | 9/1988 | Markham . | |
| 4,920,716 | * | 5/1990 | Coffey | 52/391 X |
| 5,722,746 | | 3/1998 | Hull et al. . | |
| 5,816,005 | | 10/1998 | Han . | |

FOREIGN PATENT DOCUMENTS 2 003 419 A 3/1979 (GB) .

* cited by examiner

*Primary Examiner*—David M. Purol
(74) *Attorney, Agent, or Firm*—Fulwider Patton Lee & Utecht, LLP

(57) ABSTRACT

A system comprising a plurality of prefabricated tiled panels for installation on walls, floors and counters and intended for both interior or exterior use. Panels are selected to each include a particular segment of the overall tiled array. Thus, when all the panels are installed in a previously laid out configuration and the installation is completed, the installation displays the entire tile design without unsightly breaks. Provision is made for fastening panels to framing studs or flat surfaces. Each panel comprises a single base member made from any of a selection of materials that do not need waterproofing, and any size and type of tiles. It is easy to install by any relatively unskilled person. Benefits to builders and homeowners include good quality control due to the controlled manufacturing of the panels, low cost due to methods and materials employed, and practical low cost installation, requiring substantially less skill than that required for present day on site tiling. Also, faster installation resulting in better scheduling and less intrusion into construction projects.

7 Claims, 4 Drawing Sheets

PREFABRICATED TILED PANEL SYSTEM

This application is a continuation-in-part of U.S. Ser. No. 09/334,899, entitled Complete Pre-fabricated Tile Counter in Components, now U.S. Pat. No. 6,128,793, filed Jun. 17, 1999 which is hereby incorporated by reference in its entirety.

BACKGROUND OF THE INVENTION

1. Field of the Invention

This invention relates to the installation of tiles on walls, floors and counter surfaces.

2. Background

At the present time, most tile installations are performed on site, requiring skilled, experienced professionals. In addition to being costly and time consuming, the installation involves the use of many materials, usually leaving a mess to be cleared up.

Over the past few decades a number of inventive tiling approaches have been offered to reduce the cost, installation time and subsequent mess incurred when tiled areas are required. These approaches have centered on the needs of kitchen and bathroom tiling as for example, does U.S. Pat. No. 4,771,488 by Markham which describes a prefabricated tiled counter. Yet others describe only some particular parts of tiled installations. U.S. Pat. No. 5,816,005 by Han describes a prefabricated tile panel which is illustrated as used to install tiled shower walls or a counter top. The Han panel art does not address the critical issue of proper joining of adjacent panels, nor does it address the setting of the tiles per panel to conform to the adjacent panels, but rather shows every panel in the same tile configuration. It is not apparent how the Han panels can be used to install a continuing non standard size, shape or variable tile design pattern over any given surface area that extends beyond one panel in any direction.

None of the prior or current art tiling methods and approaches provide any guidance for the installation of large area tiled surfaces, including designs or tiles of varying sizes. To install such a tiled array continues to require skilled hand installation, tile by tile at the site. Further, many of the modular type tiling innovations such as use of pretiled panels, have not been adopted by the building industry or by do-it-yourself homeowners for reasons including inherent installation defects, high required skill levels for installation or cost.

SUMMARY OF THE INVENTION

A system is described that comprises a plurality of prefabricated tiled panels for installation on walls, floors and counters, for both interior or exterior use. The panels are sized and designed each to include a particular segment of the overall tiled array. Thus, when all the panels are installed in a previously laid out configuration and the installation is completed by taping panel joints and addition of omitted tiles, the tiled installation will display the entire design without unsightly breaks. Provision is made for fastening the panels to framing studs or to flat surfaces. The panel base is a single, simple flat member and can be fabricated from a selection of materials that do not require waterproofing. However, waterproofing can be added. Tiles of any size, flat shape or material type can be adhered to a panel.

Since the panels contain no inserted metal layers, it is possible to cut any panels to fit the installation on site using only a skill saw with a carborundum blade or a tile saw.

The tiled panel system benefits builders and homeowners, because it incorporates good quality control due to the controlled manufacturing of the panels, it is relatively low in cost and is very practical to install, requiring substantially less skill than that required for present day on site tiling and would lend itself to an average do-it-yourself person.

Accordingly, embodiments of the invention can provide a prefabricated tiled panel system and method that can be used to install any size or shape tiled surface on any flat surface or on framing studs, as well as to install standard type tiled surfaces such as shower walls. Compared with existing systems and methods, embodiments of the invention can be implemented at considerably lower cost with the further advantage of increased versatility in installing a wide range of tiled designs and applications for construction interior and exterior surfaces and units.

Further advantages of the invention will be apparent from studying the specification, the claims and the attached drawings.

DESCRIPTION OF THE PREFERRED AND ALTERNATE EMBODIMENTS

The invention is a system of prefabricated tiled panels for complex or simple design tiled areas, that when installed in a predetermined configuration on a wall, floor or counter, requires little additional work to finish and complete a tiled installation.

Figure 1:
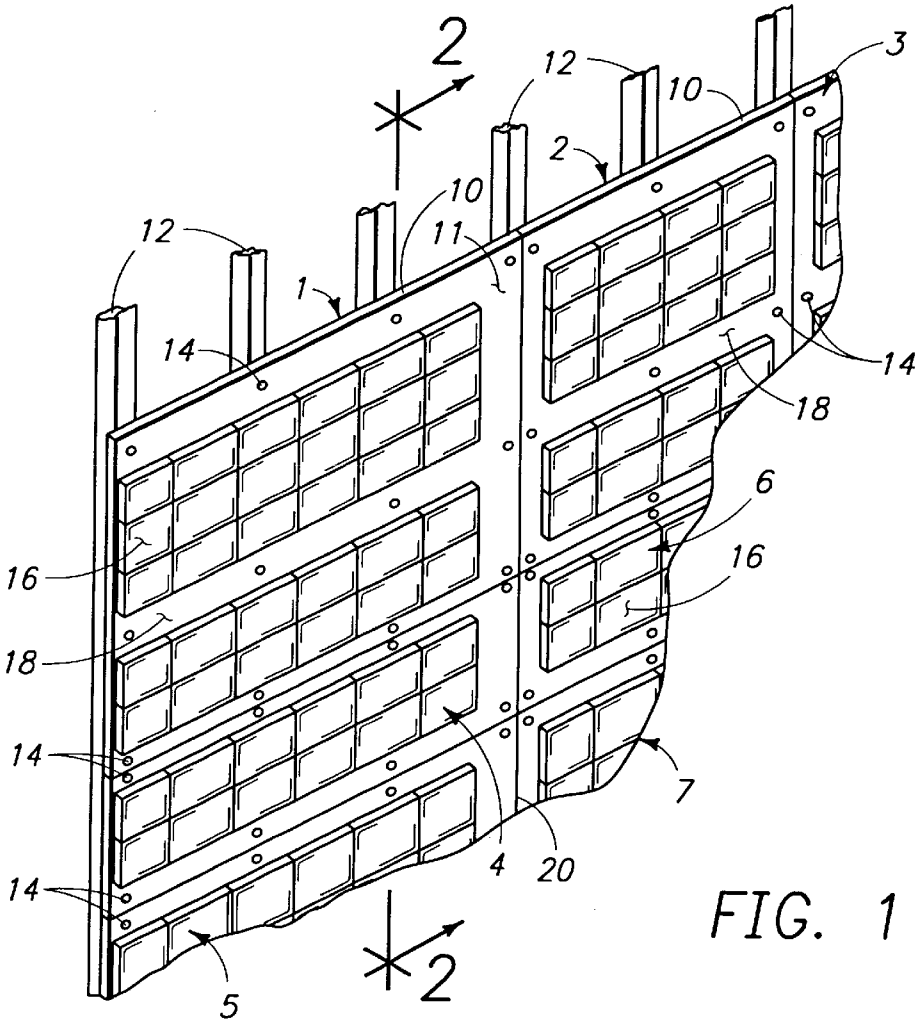
FIG. 1 is a partial perspective of a tiled panel system preferred embodiment of the present invention, nailed or screwed to wall studs and ready for finish tiling.
Figure 2:
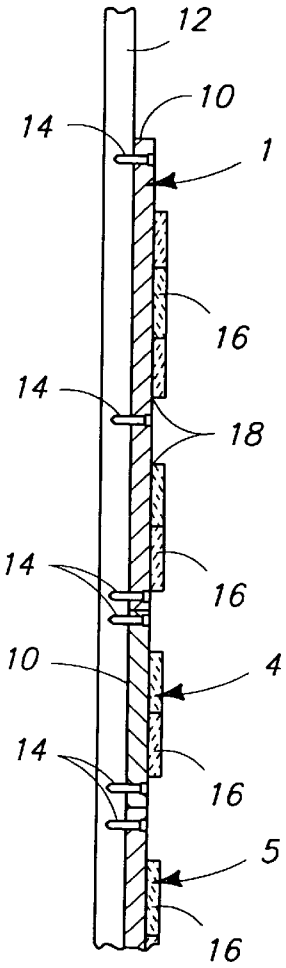
FIG. 2 is a cross-section view of the tiled panel system taken along line 2—2 of FIG. 1.

Refer to FIG. 1 which is a partial perspective of the preferred embodiment invention system of prefabricated tiled panels fastened to framing studs, and also refer to FIG. 2 which is a cross-section thereof.

Each panel is fabricated using a flat, rigid base member 10 to which tiles 16 are adhered with an adhesive and grouted. Full tiles are omitted at edge strip areas 11 where panels abut as well as at vertical intervals of 12 in. or 16 in. to allow for fastening a panel to framing studs 12 by means of nails 14, screws or other hardware. The omitted tiles are to be added and the panel edge strip areas 11 tiled after the panels are fastened in place.

The panels are fastened 14 to the vertical framing studs 12 near to the edges abutting other panels. Therefore, the width of each panel must correspond to a multiple of the stud spacing so that the panel side edges will be on a vertical framing stud. In practice, panel sizes selected depend on the size of the whole area to be tiled, the particular tiles chosen, the overall tiled area design as well as the spacing of the framing studs 12.

Figure 3:
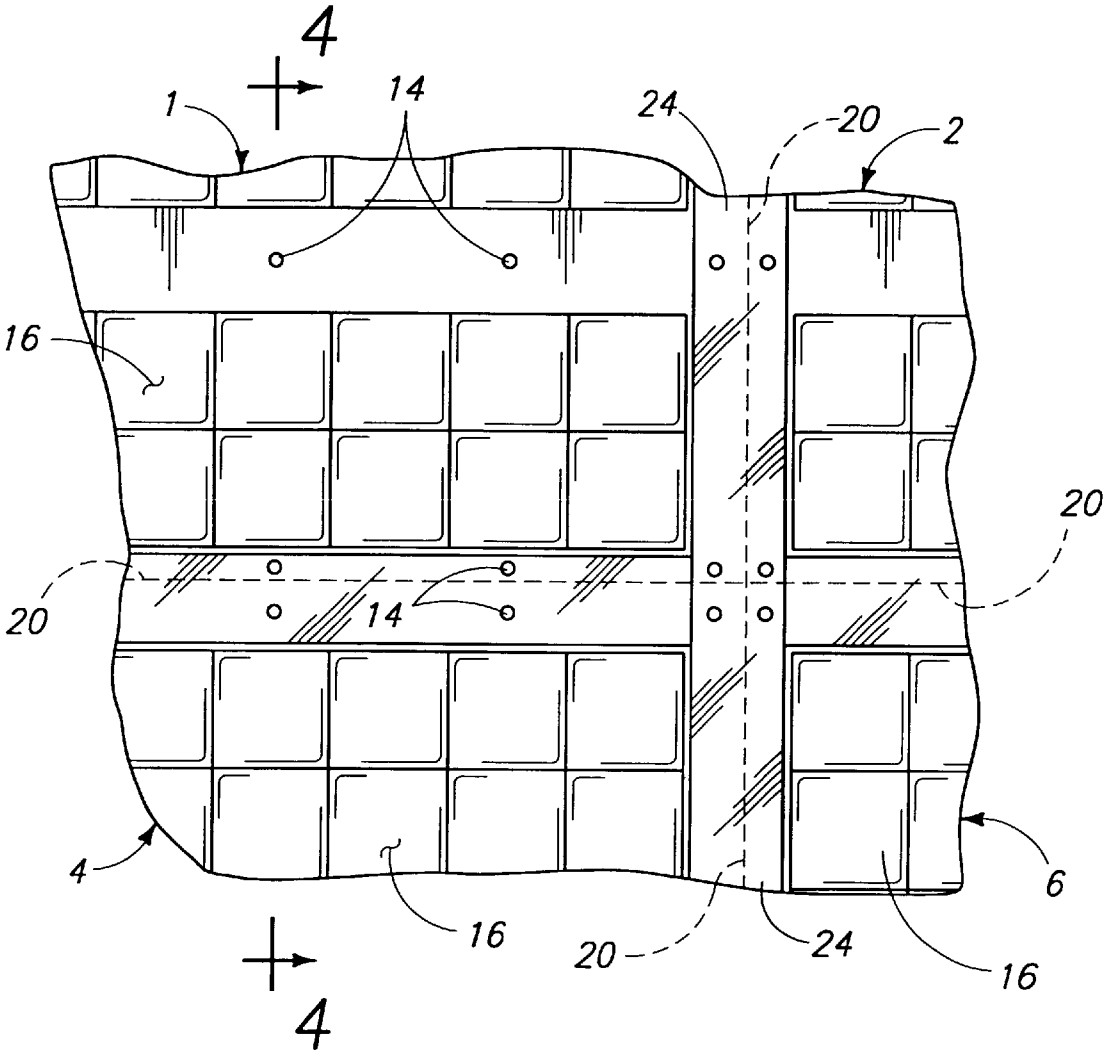
FIG. 3 is a partial plan view of four adjacent tiled panels that are nailed in place, particularly showing the addition of adhering tape covering joining edges of the panels.
Figure 4:
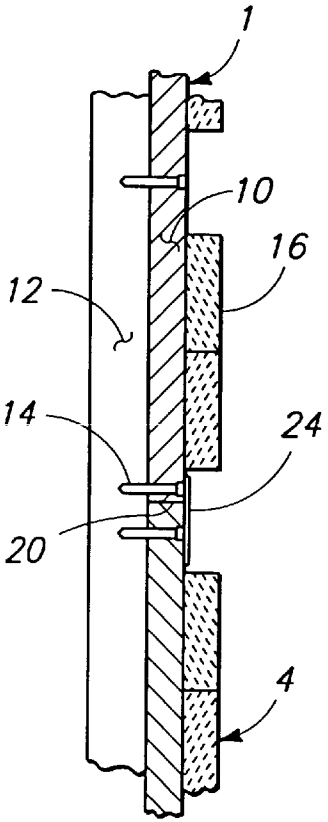
FIG. 4 is a cross-section view taken along line 4—4 of FIG. 3, particularly showing the addition of adhering tape spanning the joining edges of two adjacent panels.

Refer now to FIG. 3 which shows a partial plan view of four adjacent panels 1, 2, 4, 6 fastened in place with nails 14 and having the strip area around the panel joining edges 20 covered with a strip of a connecting and adhering tape 24. A cross-section view is shown in FIG. 4. The tape 24 is applied spanning the abutting panel edges 20 as shown to ensure that the tiled panels are properly joined before finish tiling. Otherwise, a caulk joint would be required in between each tiled panel in order for it to conform to standards set by the Tile Council of America. This would affect the looks of the tiled installation in an undesirable manner and should be avoided.

After adhering the tape 24 to the joint 20 areas, the installed panels are finish tiled and grouted, filling in all vacant spaces 18 with tiles as necessary, including any tile edging that may be needed.

Panels that have one or more edges that will abut a corner or an object such as a window edge when installed, can be cut through to fit, including cutting through the set tiled portions. This is possible because a panel is composed of only a base and adhered, grouted tiles. The cut paneled joint may then be caulked as is customary and permitted by the standards.

The panel base member may be fabricated from a cement board, greenboard, sheetrock, wood sheet, an acrylic coated tile-backer material, coated polystyrene sheet, or a foamed polystyrene sheet, and must be rigid, having parallel flat surfaces.

Any kind of tile material may be used to provide the panel tiled surface. These include ceramic tiles, stone tile, glass tile, thinbrick tile, quarry tile, mosaic tile, concrete tile, simulated stone tile or any other material that can be used as an adhered tile.

As depicted in FIG. 1, the pretiled panels need not be all the same size and shape. Panel No.1 is clearly larger than panel No.'s 2 and 4. Panels 3, 5, 6 and 7 may be yet different in size or the same as 1, 2 or 4. The selected panel sizes stem from the entire system design, and may be determined using a possible method as follows:

First, a sketched tile surface drawing, including any tile surface artwork and coloring, is laid out in scale, over an area matching the exact area to be tiled in size and shape. This drawing lay out may be scaled for convenience.

Second, the tile sizes and shapes are selected, marking them on the drawing.

Third, the drawing area is divided into the minimum number of panels needed to accommodate any corners, surface projections or variations in the contours of the surface to be tiled. Panel widths are selected to match a multiple of the spacing between framing studs when panels are to be fastened to framing studs.

Fourth, sketched complete full tiles covering or adjacent to taped panel edges are removed, as are tiles that need to be omitted for panel nail or screw attachment. What is left on each defined panel is its' particular tile array, representing only one segment of the overall integrated tiled design. Each system panel is then cut to size and the selected tiles adhered, and grouted in place on each panel as required according to that particular panel in the layout drawing. Caulking at restraining surfaces and expansion joints are added to complete the installation.

The panel system design is thus seen as flowing from one panel to another, meaning that any tile pattern or layout will continue from one panel to an adjacent panel as if it were one installation. A good way to visualize this is to imagine that a dozen boards are laid flat on the ground with the panels abutting, four wide and three down. The whole panel area is then laid with tiles in a design as if the panels were all attached, showing no breaks between panels. Now mentally remove the tiles that need to be omitted for nail or screw attachment or taping of panel joints. What is left on each panel is a design that is part of a whole system. It may further help understanding if one considers an invention panel as being somewhat analogous to a jigsaw puzzle part in that a panel displays only a portion of the entire tiled area design. This panel "puzzle part" has to be located and attached correctly to a number of other panels to reveal a significant portion of the tiled surface pattern and decoration, if any.

The invention is therefore a panel system rather than just a group of individual panels, and would generally be made to order. The size and shape of the area to be paneled and the number of panels needed in each direction would have to be known and determined in advance. Theoretically, a store could stock groups of panels that would fit together for installations such as bathtub surrounds or shower surrounds which have somewhat standard dimensions. For all other tiled areas, the panels would be made to order.

Because of the panel system's characteristic of enabling easy assembly, installation and integration of even complicated tiled art designs over any size area, the system applications are many. In addition to familiar home installations such as tiled surfaces in kitchens and bathrooms, tiled areas in laboratories and industrial areas, whether wall, table or floor can be installed using the invention panel system.

Tiled surface areas on external building walls can be installed with great economy, using the panel system. The invention system could be used with convenience and considerable effect, particularly if the tiled surface area must display a large decorative art design or a company logo. Large entrance areas with decorative, tiled floors as found in some hotels, may also be installed in this manner.

From the foregoing description, it is clear that the present invention panel system applies to many tiled area applications in a manner that is well beyond the capabilities of the prior art or currently available tiling methods.

Figure 5:
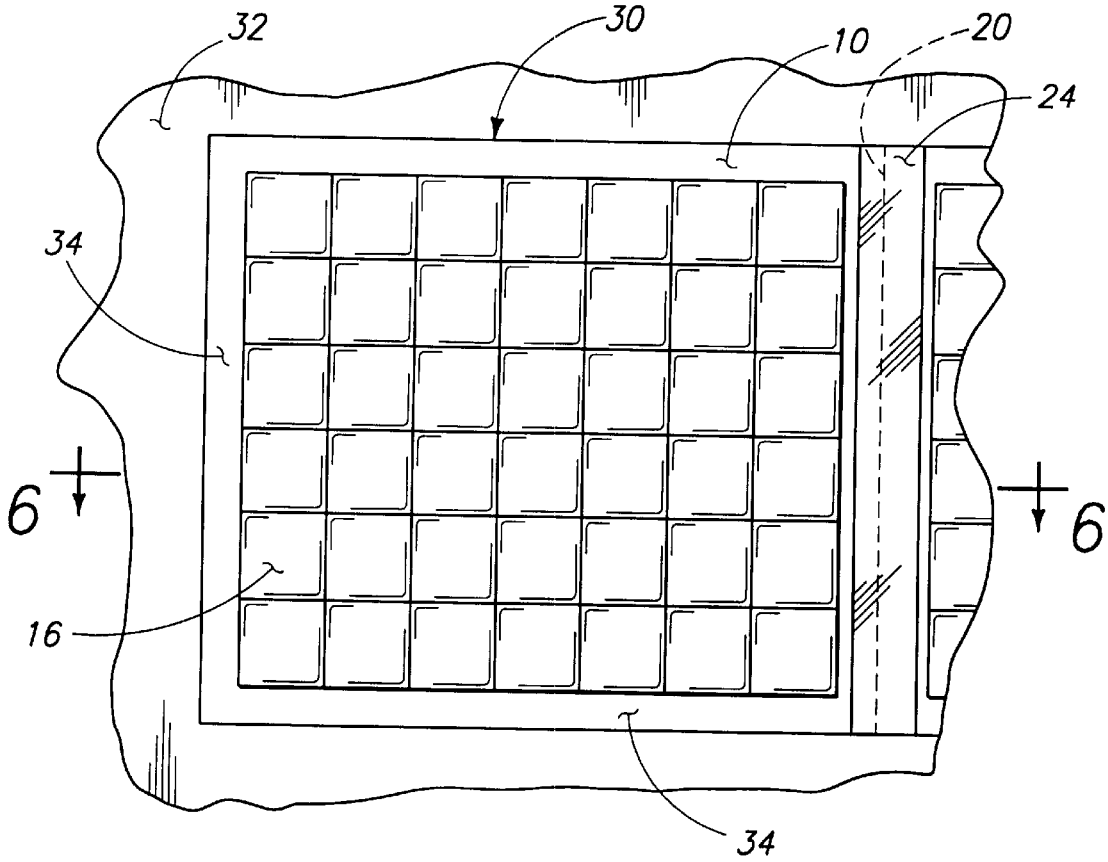
FIG. 5 is a partial plan view an alternate embodiment tiled panel system, adhered to a flat surface and ready for finish tiling.
Figure 6:
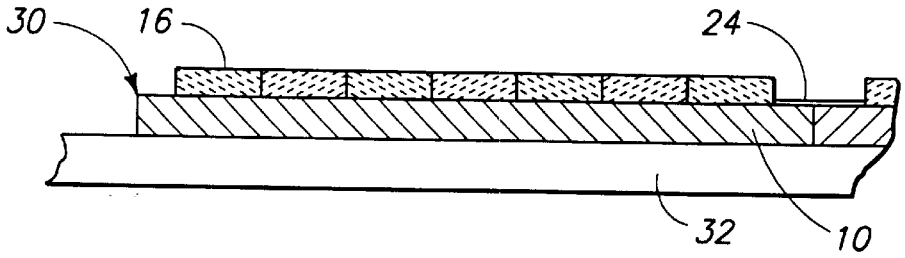
FIG. 6 is a cross-section view of a tiled panel adhered to a flat surface, taken along line 6—6 of FIG. 5.

Refer now to FIGS. 5 and 6 which are respectively, a plan view of part of an alternate embodiment panel system mounted on a flat surface, and a cross-section view of the mounted panels taken along line 6—6 of FIG. 5.

Each panel 30 is fabricated using a flat, rigid base member 10 to which tiles 16 are adhered with an adhesive and grouted. The pre-fabricated panel 30 is then attached by an adhesive to a flat surface area 32 as may be available on a wall, floor, counter top or table. It should be noted that no tiles 16 need to be omitted from the tiled array except from a strip 34 around the panel which is reserved for the application of an adhering tape 24 to cover and span the panel joining edges 20.

Figure 7:
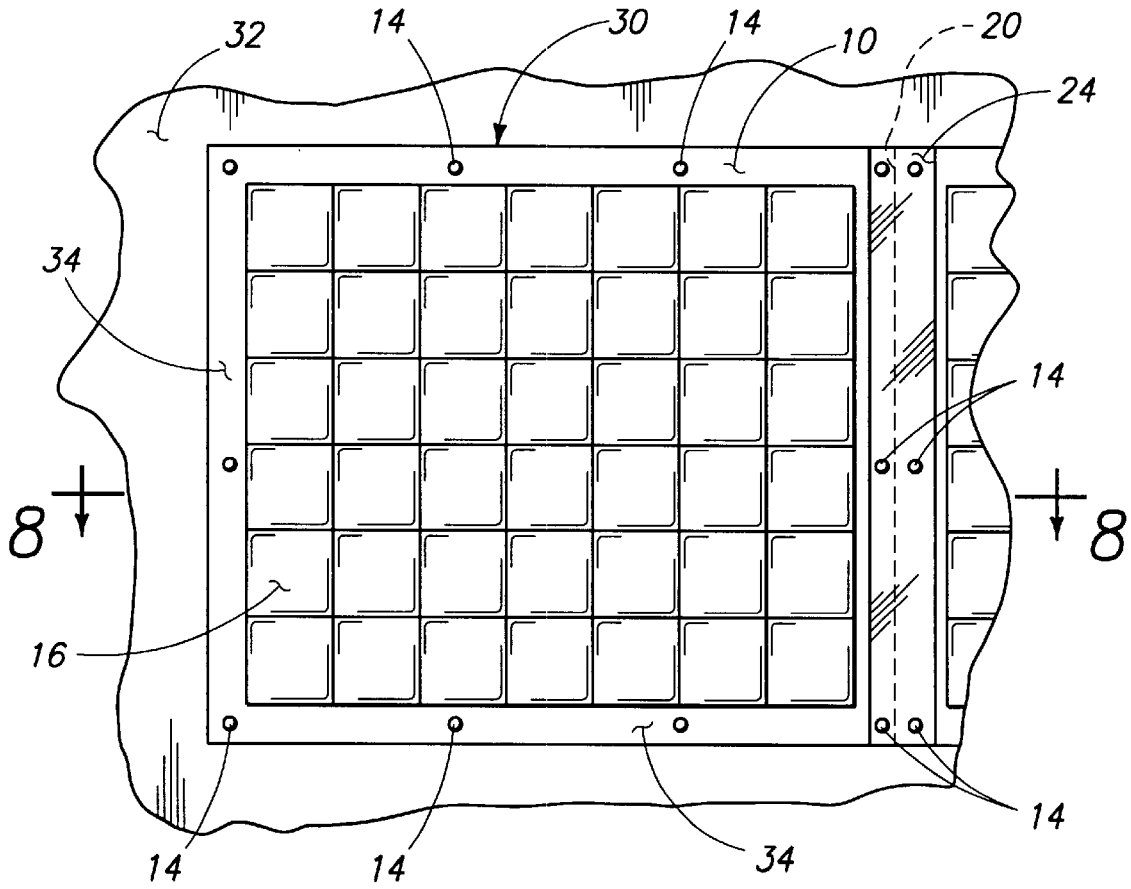
FIG. 7 is a plan view of part of an alternate embodiment tiled panel system, mechanically fastened to a flat surface by nails or screws and ready for finish tiling.
Figure 8:
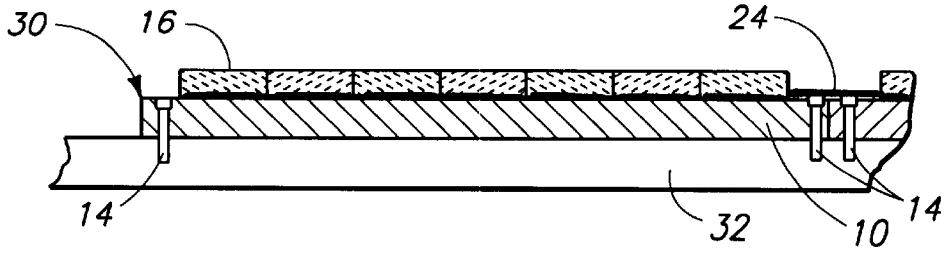
FIG. 8 is a cross-section view of part of an alternate embodiment tiled panel system, taken along line 8—8 of FIG. 7.

Refer now to FIGS. 7 and 8, which are also partial views of an alternate embodiment panel system. As an alternative or addition to the use of adhesives in fastening the panels 30 to a flat surface, mechanical means such as nails 14 or screws may also be used to attach panels through the strip 34 portion of the base member 10, before application of the tape 24.

Materials for fabricating the base member 10 and the tiles 16 are the same as those listed earlier herein for the preferred system embodiment panels. The method for laying out the tiled design pattern and selection of panel sizes, is identical to that described earlier for the preferred embodiment with one exception; the panel width as it relates to the framing studs. This is because the alternate system panels are intended to be fastened to a flat surface rather than directly to framing studs.

When the tiled panels are to be used for a floor, it may be advisable, depending on expected floor loading, to adhere the panels to a wood or other substrate and to mechanically fasten the combination to the floor. This would provide the additional needed strength for the installation.

The alternate panel system may be also employed for interior tiled applications where panels can be sized to build an entire installation as a complete unit, in components if need be. For example, in cases where the panel base members are made of wood (with or without a waterproofing membrane), a coated polystyrene or a foamed polystyrene or plastic, an entire counter installation can be built in components. That is, with backsplashes and sidesplashes as desired without need for mechanically connecting any panels.

Prefabricated or partially prefabricated tiling of polystyrene and plastic bases, especially for interior uses, represents a new and innovative method of prefabricated tile installation. This innovation would provide a lighter panel that is simpler to install with built in waterproofing, and insulation values relative to the quality of the polystyrene or plastic base. It would also be significantly less costly to consumers and users.

To summarize the benefits of the present invention system of prefabricated tiled panels, it would be most beneficial to commercial builders and individuals who want to install it themselves. The panel system comes already laid-out and mostly complete with tile and grout, and requires much less skill to install than does a tiled installation done from scratch.

The potential benefits to a builder are the quick speed of the tile-setting operation which is critical, the lower labor cost due to the reduced time it takes to install, the fact that the panels are made in a factory setting with improved quality control, a greater assurance of customer satisfaction with the resulting tiled installation, and a reduced negative impact on the environment due to the minimizing of any potentially polluting materials at the installation site.

Finally, the invention panel system and method gives reality to an easy, practical installation of any large tiled art work, whether for interior or exterior display and use.

From the foregoing description and discussion, it is believed that the embodiments of the panel system and method described herein provide numerous advantages of the present invention. Various modifications and changes may be made which are apparent to those skilled in the art. These alternatives and modifications are considered to be within the scope of the appended claims and are embraced thereby.

What is claimed is:

1. A system of prefabricated tiled panels for installation on framing studs in a predetermined configuration to produce a complete design pattern tiled surface area for a wall, floor or counter area; said system comprising a multiplicity of tiled panels; each of said panels comprising a flat, rigid base member and a number of tiles that are affixed to said base member with an adhesive and grouted to form a selected tiled array, said array being a previously defined segment of said design pattern tiled surface area, the surface area of said base member being covered by tiles except for open strips adjacent to the edges of the base member and strips between tiles, which are required to permit fastening panels to said framing studs by nails, screws or other fastening, said strips adjacent to the edges of the base member being also required to permit proper joining of one panel to the next adjacent panel during system installation; each of said panels having a width that is a multiple of the spacing between centers of said framing studs in order to facilitate fastening of said panels at near their edges to said framing studs; each of said panels having dimensions determined by a previously conducted panel layout procedure;

said tiled panels to be installed in a predetermined configuration and fastened to said frame studs, having an adhering tape applied to the open base member strips spanning joint edges between abutting panels, and having finish tiles added, adhered and grouted in panel untiled spaces including those spanning panel edges, to complete the installation of a design pattern tiled surface area.

2. The system of prefabricated tiled panels as defined in claim 1, wherein:

the material of said base member is cement board, greenboard, sheetrock, wood sheet, and acrylic coated tile-backer material, coated polystyrene, or foamed polystyrene.

3. The system of prefabricated tiled panels as defined in claim 1, wherein:

the tile material is ceramic tile, stone tile, glass tile, thinbrick tile, quarry tile, mosaic tile, concrete tile or simulated stone tile.

4. A system of prefabricated tiled panels for installation adhered to a flat surface in a predetermined configuration to produce a complete design pattern tiled surface for wall, floor or counter area, said system comprising:

a multiplicity of tiled panels; each of said panels comprising a flat, rigid base member and a number of tiles that are affixed to said base member with an adhesive and grouted to form a selected tiled array, said array being a previously defined segment of said design pattern tiled surface, the surface area of said base member being covered by tiles except for open strips adjacent to the edges of the base member, said open strips providing a space for attaching an adhesive strip over joining edges for proper joining of one panel to an adjacent panel, each of said panels having dimensions determined by a previously conducted panel layout procedure; said tiled panels to be installed in a predetermined configuration and fastened by an adhesive to said flat surface, having an adhering tape applied to the open strips spanning joint edges between abutting panels, and having finish tiles added, adhered and grouted in panel untiled spaces including those spanning panel edges to complete the installation of a design pattern tiled surface area.

5. The system of prefabricated tiled panels as defined in claim 4, wherein:

the material of said base member is cement board, greenboard, sheetrock, wood sheet, an acrylic coated tile-backer material, coated polystyrene, or foamed polystyrene.

6. The system of prefabricated tiled panels as defined in claim 4, wherein:

the tile material is ceramic tile, stone tile, glass tile, thinbrick tile, quarry tile, mosaic tile, concrete tile or simulated stone tile.

7. A method of determining the panel dimensions and tiled array characteristics of tiled panels that are fabricated according to claims 1 or 4, the method comprising the steps of:

(a) laying out a scaled size sketched tiled surface drawing, including any tile surface artwork and coloring, over a space matching the exact area, size and shape that is to be covered;

(b) selecting tile sizes and shapes and marking them on the drawing;

(c) dividing the marked tiled surface drawing into the minimum number of panels needed to accommodate any corners, surface projections or variations in the tiled area contours, and marking panel base member edges, in the case of panels to be fastened to frame studs, selecting panel widths to match a multiple of the spacing between frame studs; and (d) removing marked tiles from locations covering marked panel base member edges and from any panel space needed for fastening a panel to a surface or framing stud; producing a defined array of tiles on each panel and the dimensions of each panel.

* * * * *

UNITED STATES PATENT AND TRADEMARK OFFICE

CERTIFICATE OF CORRECTION

PATENT NO. : 6,330,774 B1
DATED : December 18, 2001
INVENTOR(S) : Albert I. Weinstein It is certified that error appears in the above-identified patent and that said Letters Patent is hereby corrected as shown below:

Column 2,
Line 46, replace "DESCRIPTION OF THE PREFERRED AND ALTERNATE EMBODIMENTS" with -- DESCRIPTION OF THE PREFERRED EMBODIMENTS --.

Signed and Sealed this

Sixteenth Day of April, 2002

*Attest:*

*Attesting Officer*

JAMES E. ROGAN
*Director of the United States Patent and Trademark Office*